US005180176A

United States Patent [19]

Chen

[11] Patent Number: 5,180,176

[45] Date of Patent: Jan. 19, 1993

[54] ELASTIC TRUCK FOR ROLLER SKATES

[75] Inventor: Ting-Hsing Chen, Tainan, Taiwan

[73] Assignee: Far Great Plastics Industrial Co., Ltd., Taiwan

[21] Appl. No.: 742,242

[22] Filed: Aug. 8, 1991

[51] Int. Cl.[5] ..... A63C 17/02

[52] U.S. Cl. ..... 280/11.28

[58] Field of Search ..... 280/11.2, 11.27, 11.28, 280/87.042, 716, 11.19

[56] References Cited

U.S. PATENT DOCUMENTS

| | | | |
|---|---|---|---|
| 2,373,220 | 4/1945 | Blaes | 280/11.28 X |
| 2,424,072 | 7/1947 | Allred | 280/11.28 |
| 2,502,153 | 3/1950 | Jack | 280/11.28 |
| 2,676,812 | 4/1954 | Owsen et al. | 280/11.28 |
| 3,161,415 | 12/1964 | Novara | 280/11.28 |
| 4,180,278 | 12/1979 | Gottlieb | 280/87.042 |
| 4,398,735 | 8/1983 | Evans et al. | 280/11.28 |
| 4,402,521 | 9/1983 | Mongeon | 280/11.28 X |

*Primary Examiner*—Margaret A. Focarino
*Assistant Examiner*—Michael Mar
*Attorney, Agent, or Firm*—Lowe, Price, LeBlanc & Becker

[57] ABSTRACT

An elastic truck for roller skates includes two brackets being located on the center top portion of a front and a rear beam, respectively, and each shaped like a bowl having recessed surfaces facing upward, two bosses that are integrally formed to the underside of the baseplate and face downward, with one boss located behind the front beam and the other one located before the rear beam, respectively, and two semispherical elastic balls having respective blind holes at the center portions. When a skater is standing on the baseplate, making a turn or a jump, the elastic balls and the blind holes will deform to absorb the vibration caused by such movement to maintain stability for skater.

2 Claims, 3 Drawing Sheets

ELASTIC TRUCK FOR ROLLER SKATES

TECHNICAL FIELD

This invention relates to the general art of roller skate structures. More particularly, the present invention relates to a stabilizer truck used in conjunction with a roller skate.

BACKGROUND ART

There has been an increased awareness for maintaining stability for a roller skater. It is especially difficult for a professional skater, who performs a lot of jumping, turning, spinning, etc., to maintain stability.

The prior art trucks enable the skater to perform relatively easy manuevers. But when the skater is required to perform a complicated skating manuever, the prior art trucks do not adequately maintain the stability of the skater.

The inventor has therefore, invented the present invention which is more stable than prior art.

DISCLOSURE OF THE INVENTION

It is the primary object of the present invention to provide an elastic truck for roller skates which serves as a second shock absorbing device to the skater.

It is another object of the present invention to provide an elastic truck for roller skates which allows greater stability.

It is still another object of the present invention to provide an elastic truck for roller skates which allows better maneuverability.

DETAILED DESCRIPTION OF THE PREFERRED EMBODIMENT

Figure 1:
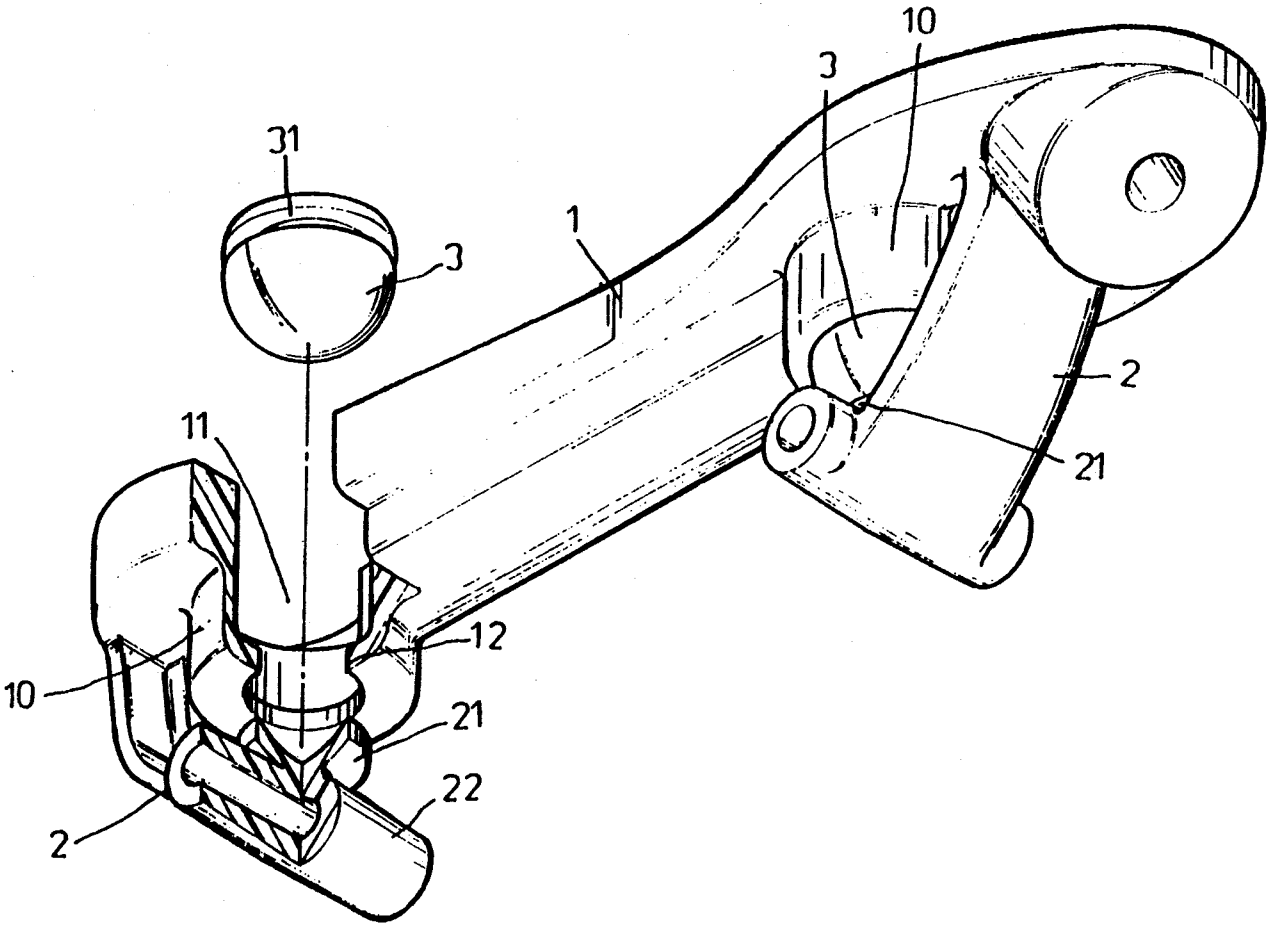
FIG. 1 is a partially exploded perspective view of the present invention.
Figure 2:
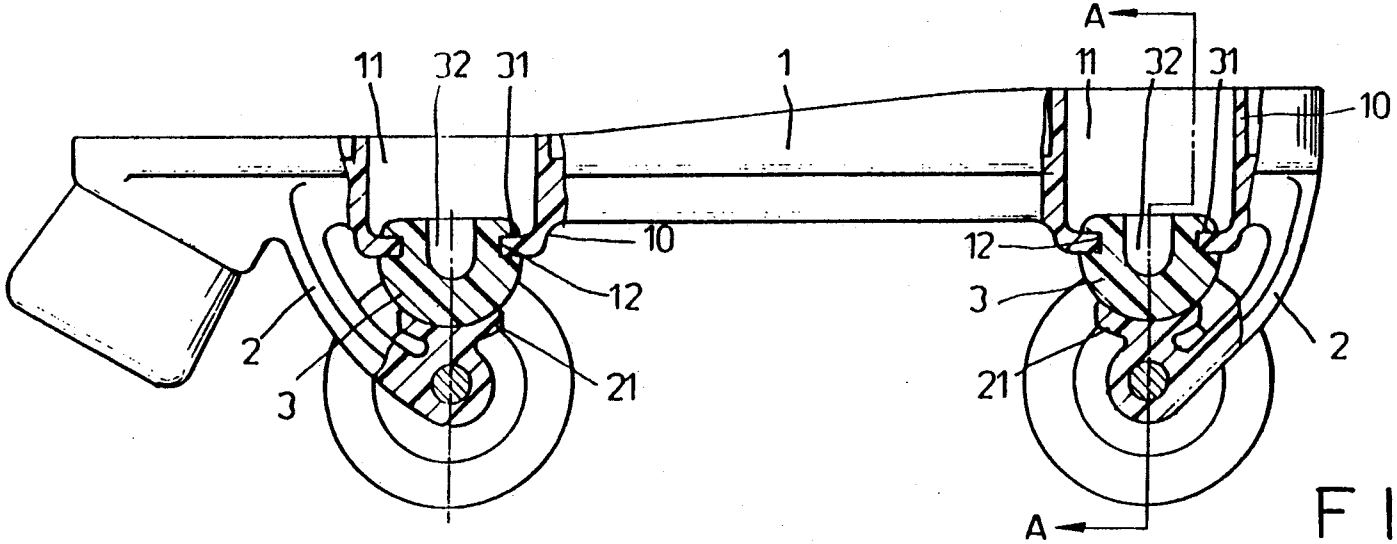
FIG. 2 is a partially sectioned side view of FIG. 1.

Referring to FIG. 1, the present invention comprises a baseplate 1, with two beams 2 formed with their top ends integral to the underside of the baseplate 1 with one beam at the front and another beam at the rear portions, respectively. Two bosses 10 are integrally formed to the bottom portion of the baseplate 1 facing downwardly, with one boss located near the rear portion of the front beam 2 and another boss located near the front portion of the rear beam 2. Two axle hubs 22 are connected to the bottom end of respective beams 2 and extending perpendicularly thereto. On the middle top portion of each of the axle hubs 22, there are integrally formed two brackets 21, each having a recessed surface facing upwardly. Boss 10 have respective through bores 11 and flanges 12 at its top inner portion. Each of two semispherical elastic balls 3 has a blind hole 32 at top center portion and a circular groove 31 that is near the top end that is sized to allow the flange 12 of the boss 10 to be inserted. When each elastic ball 3 is placed into the respective boss 10, the flange 22 of each boss 10 is inserted into each circular groove 31. The bottom portion of each ball 3 below the groove 31 is disposed underneath each boss 10 and seats on the recess surface of the respective bracket, as shown in FIG. 2.

Each flange 12 is inserted into the groove 31 of each semispherical ball 3 such that when a skater is standing on the baseplate 1, the ball 3 will only deform because of the skater's weight and will not separate from the corresponding boss 10.

Figure 3:
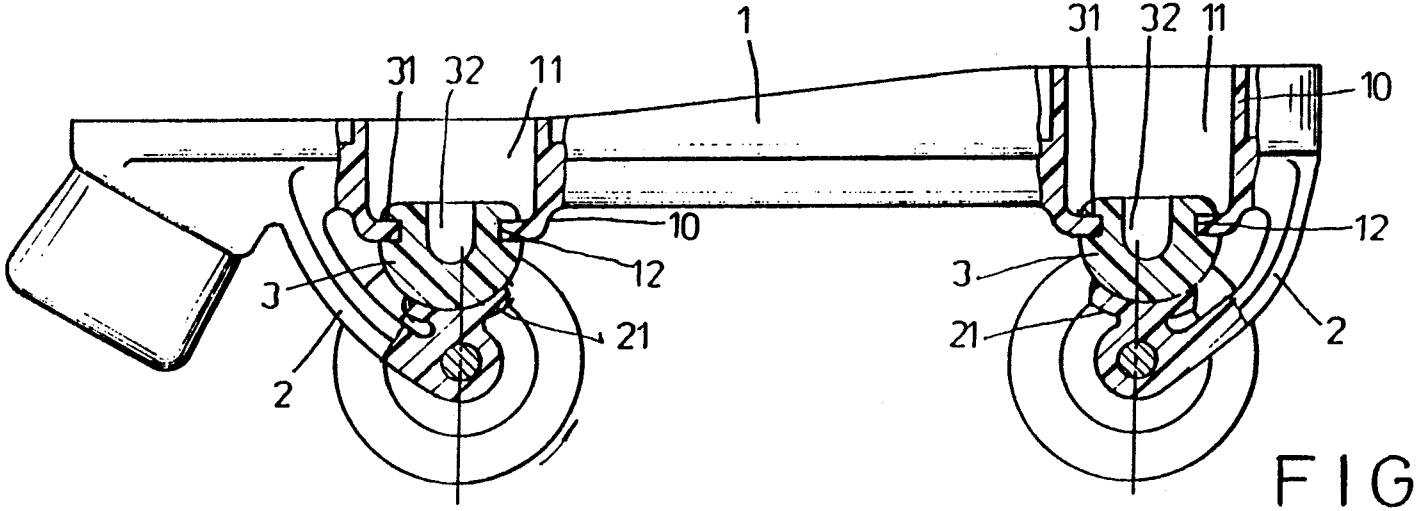
FIG. 3 is a partially sectioned side view comparable to FIG. 2 showing a force being applied on the skate.

When a skater steps on the baseplate 1, the front beam 2 will deflect rearwardly, and the rear beam 2 will deflect forwardly. These movements of the beams 2 limit the respective magnitudes of the corresponding upward flexing force transferred to the elastomeric balls 3. When the brackets 21 pushes the balls 3 upward, the balls 3 and the blind holes 32 therein will deform to absorb the flexing force, as shown in FIG. 3.

Figure 4:
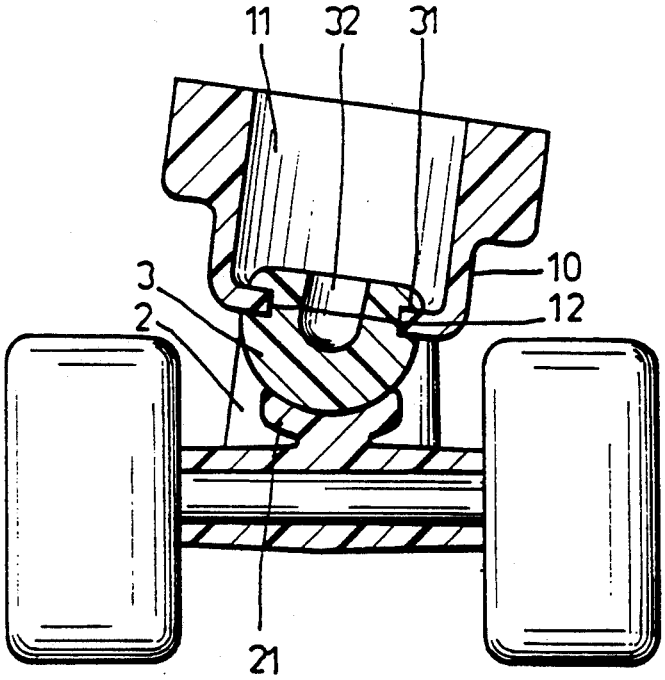
FIG. 4 is a sectional view of FIG. 3 taken along line A—A illustrating the manner in which a skater leans to one side in order to effect a turn.

FIG. 4 is a sectional view illustrating the truck as a skater leans to the left. The left sides of the balls 3 and the blind holes 32 thereof are deformed in order to absorb the force resulting from the wearer's weight shifting to effect the left turn.

Figure 5:
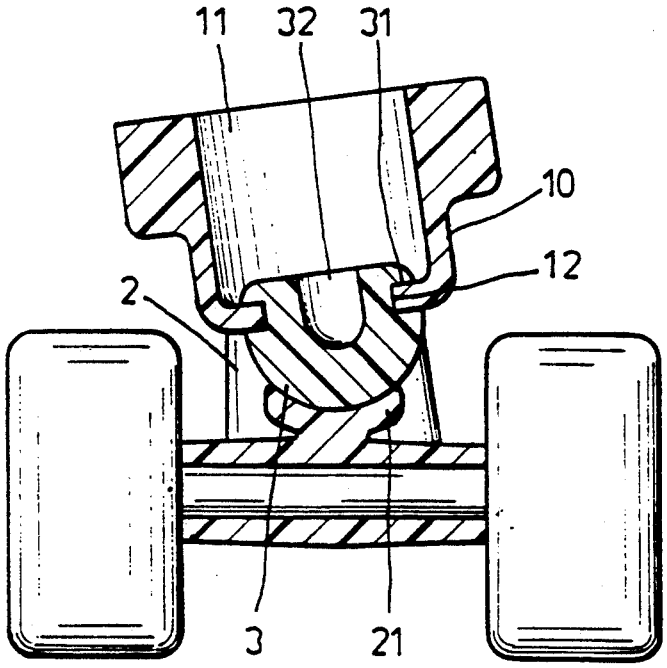
FIG. 5 is a view comparable to FIG. 4 illustrating the skater leaning to another side to effect an opposite turn.

In like manner, when the skater's weight is shifted to the right side of the skate, as shown in FIG. 5, the right side of the balls 3 and the blind holes 32 are deformed in order to absorb the force resulting from weight shifting to effect the right turn.

Although the present invention has been described and illustrated in detail, it is clearly understood that the same is by way of illustration and example only, and is not to be taken by way of limitation, the spirit and scope of the present invention being limited only by the terms of the appended claims.

I claim:

1. An elastic truck for a roller skate comprising:

a baseplate;

curved front and curved rear beams, with an upper portion of each beam being integrally formed to an underside of said baseplate, with said front beam located at a front portion of said baseplate and said rear beam being located at a rear portion of said baseplate;

two brackets, each of which has a bowl-shaped recess, respectively formed on lower portions of said beams, with said recesses facing upward;

cylindrical front and rear bosses, with an upper portion of each boss being integrally formed to said underside of said baseplate, with each boss having an inner bore generally perpendicular to said underside of said baseplate, with said front boss being located directly above the bracket of said front beam and said rear boss being located directly above the bracket of said rear beam; and two generally semispherical elastic elements respectively mounted to said front and rear bosses, each elastic element having a lower spherical portion disposed outwardly of said bosses and seated into the corresponding recesses of said brackets and each elastic element also having an upper portion secured to a respective boss, each upper portion having a top surface with an open blind cavity extending therein;

wherein said blind cavities permits said elastic elements to flex and deform in correspondence with the magnitude and direction of an applied force.

2. An elastic truck for a roller skate according to claim 1, wherein:

each of said bosses has a flange at a lower inner portion, and each of said elastic elements has a matching circular groove at said upper portion; and said groove engages with said flange to secure said elastic element to the respective boss.

* * * * *